US006583769B2

(12) United States Patent
Shiroki et al.

(10) Patent No.: US 6,583,769 B2
(45) Date of Patent: Jun. 24, 2003

(54) CHIP ANTENNA

(75) Inventors: Koji Shiroki, Kyoto-fu (JP); Kenji Asakura, Kyoto-fu (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 09/894,938

(22) Filed: Jun. 28, 2001

(65) Prior Publication Data

US 2002/0008673 A1 Jan. 24, 2002

(30) Foreign Application Priority Data

Jul. 31, 2000 (JP) ..... 2000-231117

(51) Int. Cl.[7] ..... H01Q 1/36; H01Q 1/24
(52) U.S. Cl. ..... 343/895; 343/702
(58) Field of Search ..... 343/895, 702; H01Q 1/36, 1/38, 1/24

(56) References Cited

U.S. PATENT DOCUMENTS 4,644,366 A * 2/1987 Scholz ..... 343/895
5,541,610 A * 7/1996 Imanishi et al. ..... 343/702

FOREIGN PATENT DOCUMENTS

EP 0863570 9/1998
FR 2702091 9/1994
JP 4242911 8/1992
JP 8316725 11/1996

OTHER PUBLICATIONS

Patent Abstracts of Japan vol. 2000, No. 04, Aug. 31, 2000 & JP 2000 013132 A (TDK Corp), Jan. 14, 2000.

Patent Abstracts of Japan vol. 1998, No. 08, Jun. 30, 1998 & JP 10 084216 (Saitama Nippon Denki KK), Mar. 31, 1998.

Cardosa et al. "A Spherial Helical Antenna" Antennas and Propagation Society International Symposium, 1993. AP–S. Digest Ann Arbor, MI, USA Jun. 28–Jul. 2 1993, New York, NY IEEE, Jun. 28, 1993 pp. 1558–1561.

* cited by examiner

*Primary Examiner*—Michael C. Wimer
(74) *Attorney, Agent, or Firm*—Keating & Bennett, LLP

(57) ABSTRACT

A chip antenna capable of reducing the spiral pitch of an antenna line to be smaller than that of a conventional one. Conductor patterns are electrically connected sequentially in series through via holes so as to form a spiral antenna line. The antenna line has a winding axis which is arranged either in a zigzag manner or along a straight line. Adjacent wound portions have an equal diameter or width or the adjacent portions may have unequal widths. Since adjacent via holes are arranged in a staggered arrangement with each other, the distance between the adjacent via holes is larger than the spiral pitch of the antenna line, allowing the adjacent portions to be closer together than a conventional chip antenna, thereby allowing the resonance frequency to be reduced.

22 Claims, 7 Drawing Sheets

CHIP ANTENNA

BACKGROUND OF THE INVENTION

1. Field of the Invention

The present invention relates to chip antennas, and in particular relates to a chip antenna for mobile communication units such as portable telephone terminals and pagers and a chip antenna for local area networks (LANs).

2. Description of the Related Art

It is important for antennas for use in mobile communication units and LANs to be small-sized. As one of the antennas satisfying such a demand, a helical-type chip antenna is known.

An example of a conventional helical-type chip antenna is shown in FIGS. 9 and 10. A chip antenna 100 comprises a rectangular-solid dielectric base body 121, an antenna line 130 disposed in the dielectric base body 121, a feed terminal 110, and a fixing terminal 111. One end 134 of the antenna line 130 is electrically connected to the feed terminal 110 and the other end 135 is unconnected.

The antenna line 130 is formed by alternately connecting a conductor pattern 131 and a via hole 132 in series. The antenna line 130 has a helical structure having a uniform width and height (or diameter) and the pitch P, and is wound about a straight axis CL in the horizontal direction (direction of arrow X in the drawing).

In order to enable a chip antenna also to be used at low frequencies, the chip antenna is generally required to reduce the resonance frequency. One of the methods for reducing the resonance frequency of the chip antenna is to decrease the spiral pitch of the antenna line.

However, since in the conventional chip antenna 100, adjacent via holes 132 are close to each other, there is a problem that the spiral pitch of the antenna line 130 cannot be reduced much due to limitation in manufacturing.

SUMMARY OF THE INVENTION

Accordingly, it is an object of the present invention to provide a chip antenna capable of reducing the spiral pitch of an antenna line so that it is smaller than that of a conventional chip antenna.

In order to achieve the above-mentioned object, in accordance with a first aspect of the present invention, a chip antenna comprises a base body, an antenna line disposed in the base body and being spirally wound, and a feed terminal disposed on a surface of the base body and being electrically connected to one end of the antenna line, wherein the antenna line has a winding axis which curves in a zigzag manner.

In accordance with a second aspect of the present invention, a chip antenna comprises a base body, an antenna line disposed in the base body and being spirally wound, and a feed terminal disposed on a surface of the base body and being electrically connected to one end of the antenna line, wherein the antenna line has a substantially straight winding axis, and adjacent wound portions have a different width or diameter.

More specifically, the antenna line may be formed by electrically connecting a plurality of conductor patterns disposed in the base body in series by via holes which are arranged in the base body in a staggered arrangement.

By the structures described above, the minimum spiral pitch of the antenna line can be smaller than that of a conventional antenna, thereby enabling the resonance frequency of the chip antenna to be reduced to less than that of a conventional chip antenna.

A chip antenna according to the present invention may further comprise an opposing conductor for adjusting the resonance frequency, wherein the opposing conductor opposes at least one of the plurality of conductor patterns forming the antenna line and is electrically connected to part of the plurality of conductor patterns. Thereby, when the area of the opposing conductor for adjusting the resonance frequency is changed, the resonance frequency of the chip antenna can be adjusted without changing the number of winding turns of the antenna line.

BRIEF DESCRIPTION OF THE DRAWING(S)

DETAILED DESCRIPTION OF EMBODIMENTS OF THE INVENTION

Embodiments according to the present invention will be described below with reference to the attached drawings.

Figure 1:
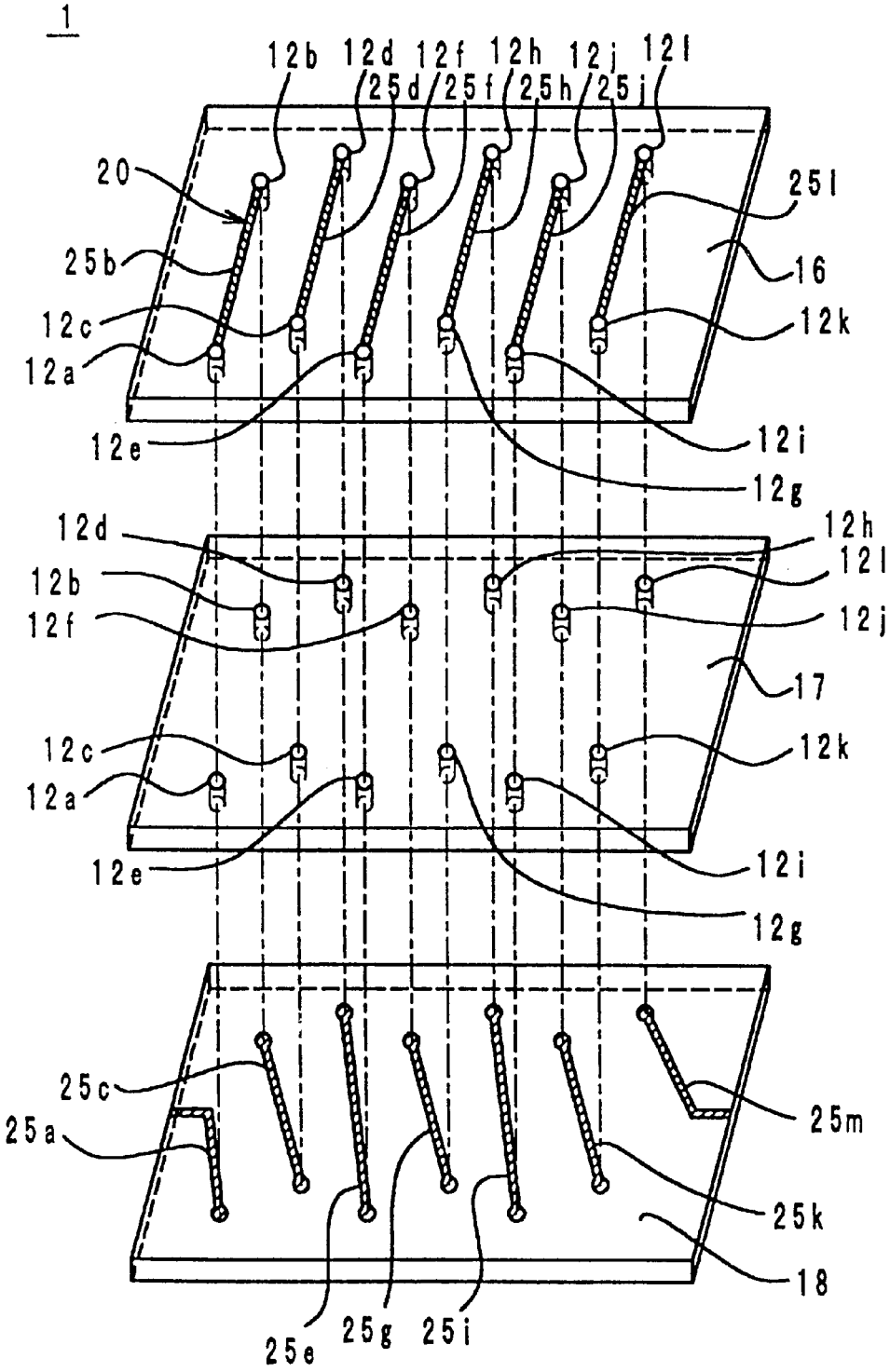
FIG. 1 is an assembly view of a chip antenna according to a first embodiment of the present invention.
Figure 2:
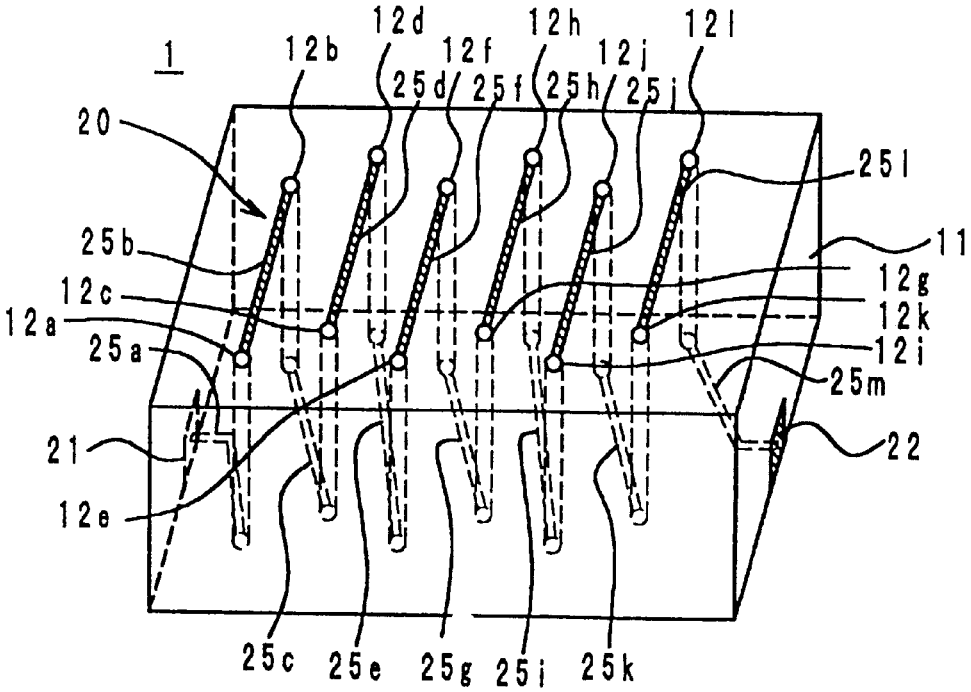
FIG. 2 is a perspective view of the chip antenna shown in FIG. 1.
Figure 3:
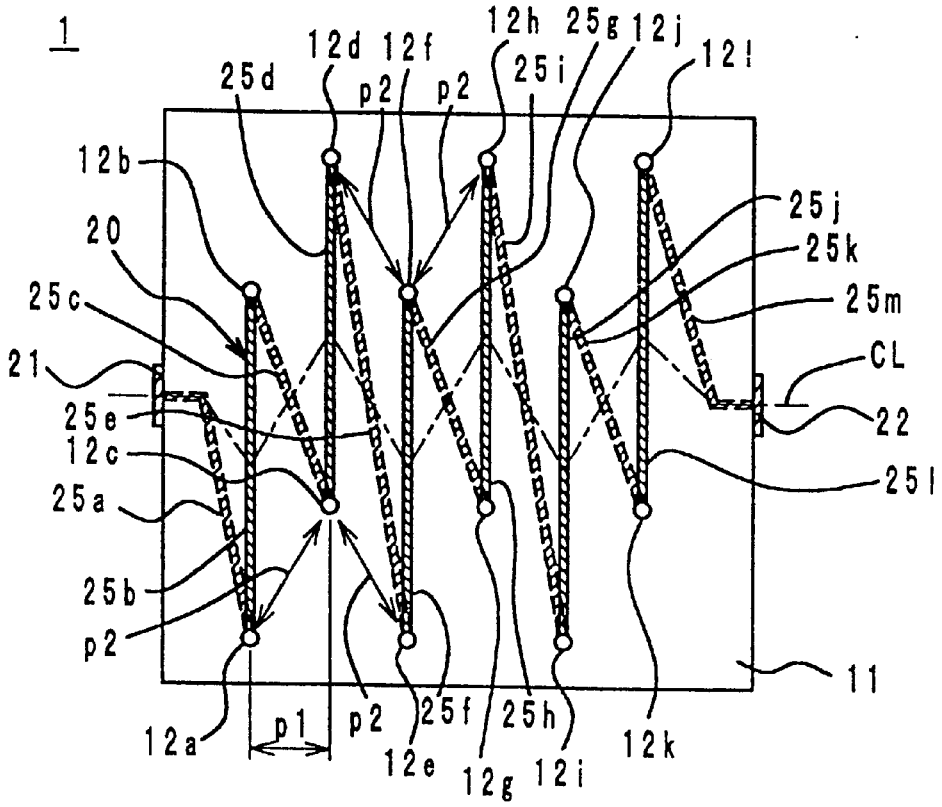
FIG. 3 is a plan view of the chip antenna shown in FIG. 1.

First Embodiment, FIGS. 1 to 3

FIG. 1 is an assembly view showing a chip antenna 1; FIG. 2 is an external perspective view of the chip antenna 1 shown in FIG. 1; and FIG. 3 is a plan view of the chip antenna 1 shown in FIG. 1.

As is shown in FIG. 1, the chip antenna 1 comprises a dielectric sheet 16 having conductor patterns 25*b*, 25*d*, 25*f*, 25*h*, 25*j*, and 25*l* and via holes 12*a* to 121 formed thereon, a dielectric sheet 17 having the via holes 12*a* to 121 formed thereon, and a dielectric sheet 18 having conductor patterns 25*a*, 25*c*, 25*e*, 25*g*, 25*i*, 25*k*, and 25*m* formed on the top face of the dielectric sheet 18.

The conductor patterns 25*a* to 25*m* are formed on the surfaces of the respective dielectric sheets 16 and 18 by a method such as printing, sputtering, vapor deposition, pasting, or plating. As a material of the conductor patterns 25*a* to 25*m*, Ag, Ag—Pd, Au, Pt, Cu, Ni, etc., are used. As a material of the dielectric sheets 16 to 18, a resin such as a fluorocarbon resin, ceramic containing barium oxide, aluminum oxide, silica, etc. as principal ingredients, and a mixture of ceramic and a resin are used. The via holes 12*a* to 12*l* may be formed by filling holes formed on the dielectric sheets 16 and 17 with conductive paste.

The conductor patterns 25*a* to 25*m* are electrically connected sequentially in series by the via holes 12*a* to 12*l* formed on the dielectric sheets 16 and 17 so as to form a spiral antenna line 20. One end of the spiral antenna line 20 (i.e., the conductor pattern 25*a*) is exposed to the left side of the conductor sheet 18 and the other end (i.e., the conductor pattern 25*m*) is exposed to the right side of the conductor sheet 18.

The conductor patterns 25*b*, 25*d*, 25*f*, 25*h*, 25*j*, and 25*l* formed on the surface of the dielectric sheet 16 have an equal length and are arranged in parallel to each other at intervals of a predetermined pitch. The conductor patterns 25*b*, 25*f*, and 25*j* and the conductor patterns 25*d*, 25*h*, and 25*l* are each alternately arranged in a staggered arrangement. Similarly, the conductor patterns 25*a*, 25*c*, 25*e*, 25*g*, 25*i*, 25*k*, and 25*m* formed on the top surface of the dielectric sheet 18 also have an equal length and are arranged in parallel to each other at intervals of a predetermined pitch. Furthermore, the via holes 12*a*, 12*c*, 12*e*, 12*g*, 12*i*, and 12*k* are alternately arranged in a staggered arrangement, and the via holes 12*b*, 12*d*, 12*f*, 12*h*, 12*j*, and 12*l* are alternately arranged in a staggered arrangement.

The dielectric sheets 16 to 18 described above, as shown in FIG. 1, are sequentially deposited and unitarily burned so as to form a dielectric base body 11 as shown in FIG. 2. At both ends of the dielectric base body 11, terminals 21 and 22 are respectively disposed. The terminal 21 is electrically connected to the conductor pattern 25*a* while the terminal 22 is electrically connected to the conductor pattern 25*m*. Any one of the terminals 21 and 22 is used as a feed terminal and the other is for as a fixing terminal. The terminals 21 and 22 may be formed of conductive paste such as Ag, Ag—Pd, Cu, or Ni by a method such as coating, burning, or further wet plating thereon.

In the chip antenna 1 formed as described above, as shown in FIG. 3, the antenna line 20 has a winding axis CL which curves in a zigzag manner, and adjacent spiral portions have an equal diameter. Since adjacent via holes (the via holes 12*a*, 12*c*, 12*e*, 12*g*, 12*i*, and 12*k*, for example) are arranged in a staggered arrangement with each other, the distance P2 between adjacent via holes (the via holes 12*a* and 12*c*, for example) is larger than the spiral pitch P1 of the antenna line 20. Therefore, even when the spiral pitch P1 of the antenna line 20 is reduced to be smaller, the distance P2 between the adjacent via holes 12*a* and 12*c* can be larger than that of a conventional antenna line, so that limitation in manufacturing may be circumvented. Consequently, the minimum spiral pitch of the antenna line 20 can be smaller than that of a conventional one, thereby enabling the resonance frequency of the chip antenna 1 to be reduced approximately 20% smaller than that of a conventional chip antenna.

Figure 4:
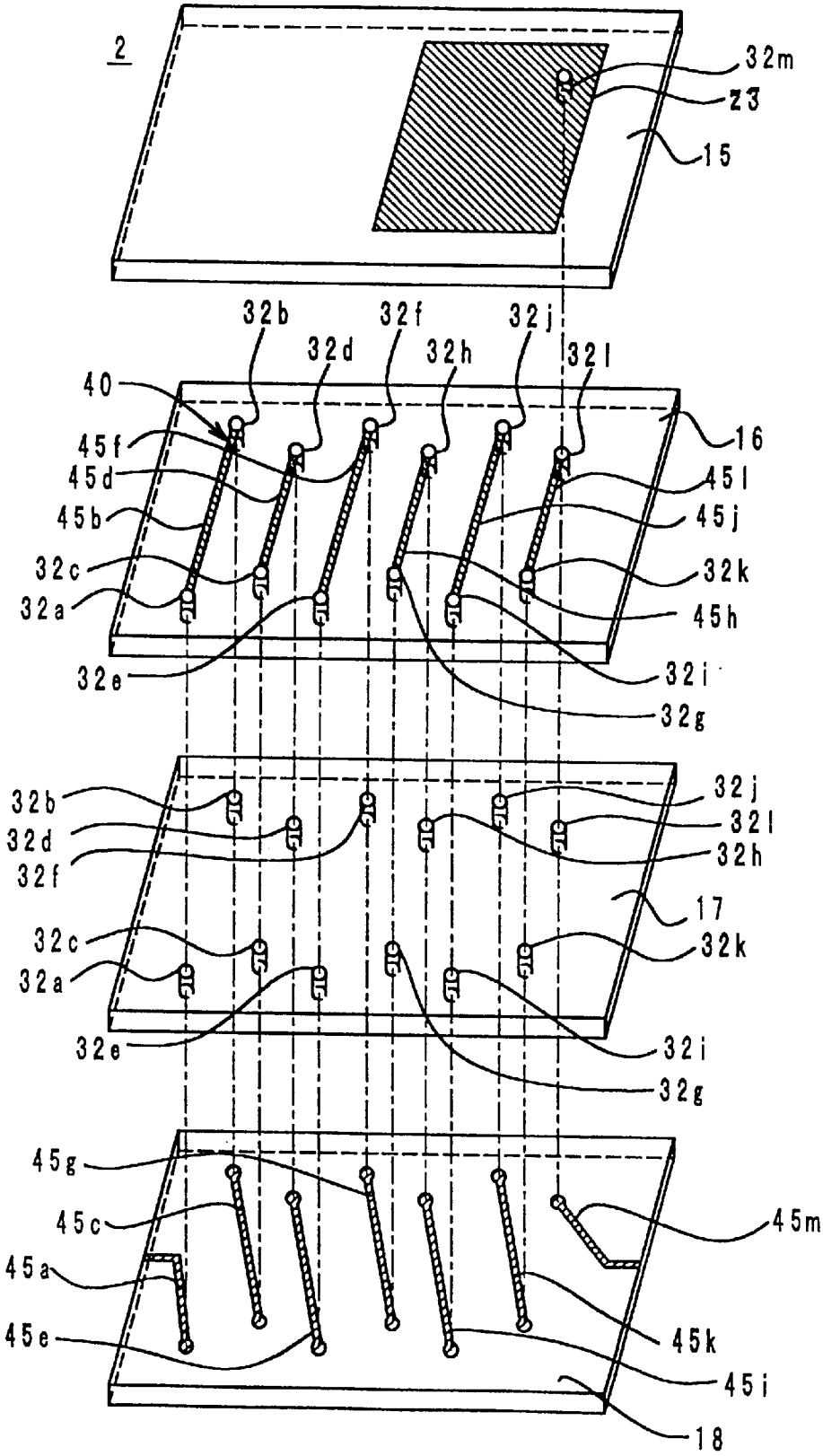
FIG. 4 is an assembly view of a chip antenna according to a second embodiment of the present invention.
Figure 5:
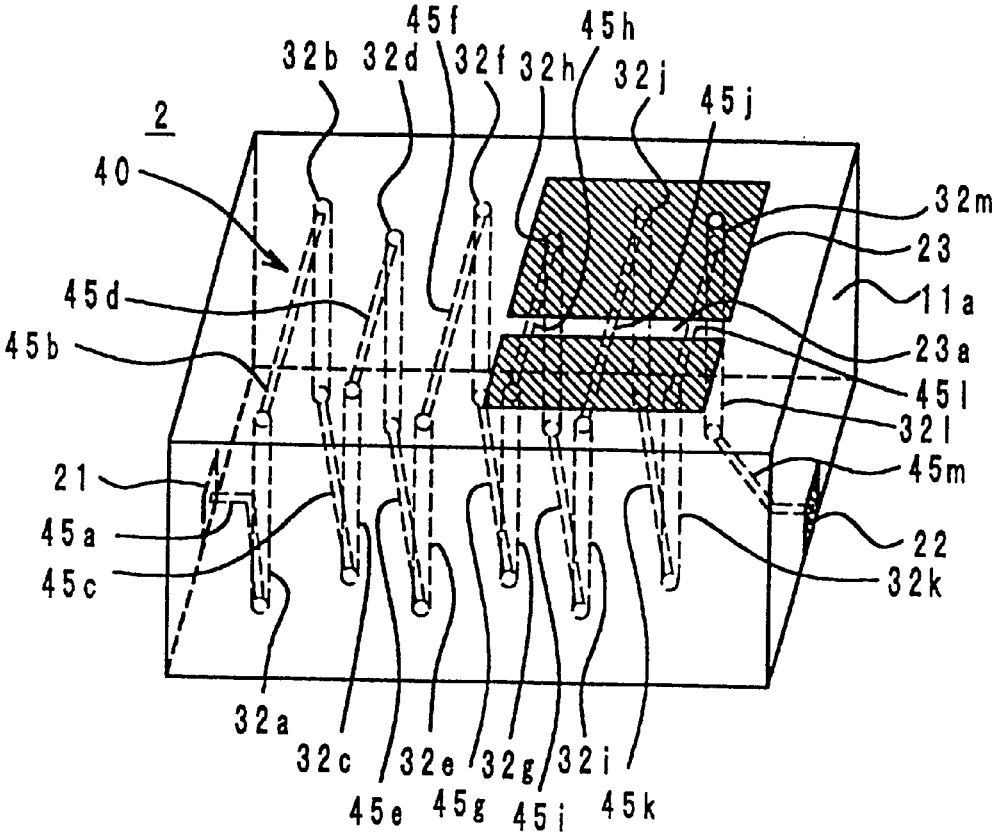
FIG. 5 is a perspective view of the chip antenna shown in FIG. 4.
Figure 6:
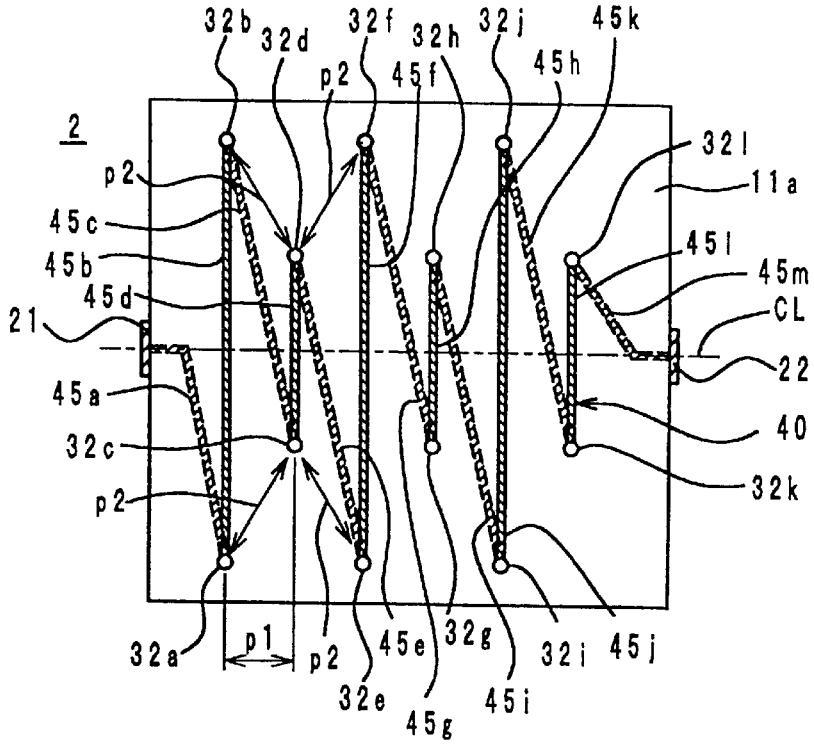
FIG. 6 is a plan view of the chip antenna shown in FIG. 4.

Second Embodiment, FIGS. 4 to 6

FIG. 4 is an assembly view of a chip antenna 2; FIG. 5 is an exterior perspective view of the chip antenna 2 shown in FIG. 4; FIG. 6 is a plan view of the chip antenna 2 shown in FIG. 4; however, in FIG. 6, an opposing conductor 23 for adjusting the resonance frequency and a via hole 32*m* are not shown.

As is shown in FIG. 4, the chip antenna 2 comprises a dielectric sheet 15 having the opposing conductor 23 for adjusting the resonance frequency and the via hole 32*m* formed thereon, a dielectric sheet 16 having conductor patterns 45*b*, 45*d*, 45*f*, 45*h*, 45*j*, and 45*l* and via holes 32*a* to 32*l* formed thereon, a dielectric sheet 17 having the via holes 32*a* to 321 formed thereon, and a dielectric sheet 18 having conductor patterns 45*a*, 45*c*, 45*e*, 45*g*, 45*i*, 45*k*, and 45*m* formed on the top face of the dielectric sheet 18.

The conductor patterns 45*a* to 45*m* are electrically connected sequentially in series via the via holes 32*a* to 32*l* formed on the dielectric sheets 16 and 17 so as to form a spiral antenna line 40. One end of the spiral antenna line 40 (i.e., the conductor pattern 45*a*) is exposed to the left side of the conductor sheet 18 and the other end (i.e., the conductor pattern 45*m*) is exposed to the right side of the conductor sheet 18.

The conductor patterns 45*b*, 45*f*, and 45*j* formed on the top surface of the dielectric sheet 16 have an equal length and are arranged alternately with and in parallel to the conductor patterns 45*d*, 45*h*, and 45*l* having a smaller length than that of the conductor patterns 45*b*, 45*f*, and 45*j* at intervals of a predetermined pitch. Similarly, the conductor patterns 45*a*, 45*c*, 45*e*, 45*g*, 45*i*, 45*k*, and 45*m* formed on the top surface of the dielectric sheet 18 also have an equal length and are arranged at intervals of a predetermined pitch. Furthermore, the via holes 32*a*, 32*c*, 32*e*, 32*g*, 32*i*, and 32*k* are alternately arranged in a staggered arrangement, and the via holes 32*b*, 32*d*, 32*f*, 32*h*, 32*j*, and 32*l* are alternately arranged in a staggered arrangement.

The opposing conductor 23 for adjusting the resonance frequency is formed in a position opposing the conductor patterns 45*h* to 45*l* and is electrically connected to the conductor pattern 45*l* via the via hole 32*m*.

The dielectric sheets 15 to 18 described above, as shown in FIG. 4, are sequentially deposited and unitarily burned so as to form a dielectric base body 11 a as shown in FIG. 5. At both ends of the dielectric base body 11*a,* terminals 21 and 22 are respectively disposed. The terminal 21 is electrically connected to the conductor pattern 45*a* while the terminal 22 is electrically connected to the conductor pattern 45*m*.

In the chip antenna 2 formed as described above, as shown in FIG. 6, the antenna line 40 has a straight winding axis CL, and adjacent wound portions thereof have a different diameter. Since adjacent via holes (the via holes 32*a*, 32*c*, 32*e*, 32*g*, 32*i*, and 32*k*, for example) are arranged in a staggered arrangement, the distance P2 between adjacent via holes (the via holes 32*a* and 32*c*, for example) is larger than the spiral pitch P1 of the antenna line 40. Therefore, even when the spiral pitch P1 of the antenna line 40 is reduced to be smaller, the distance P2 between the adjacent via holes 32*a* and 32*c* can be larger than that of a conventional antenna line, so that limitation in manufacturing may be circumvented. Consequently, the minimum spiral pitch of the antenna line 40 can be smaller than that of a conventional one, thereby enabling the resonance frequency of the chip antenna 2 to be reduced approximately 20% smaller than that of a conventional chip antenna.

As is shown in FIG. 5, the opposing conductor 23 for adjusting the resonance frequency formed on the top surface of the dielectric base body 1 a is cut by forming a slit 23*a* on the opposing conductor 23 using a laser, sandblasting, etching, a knife, etc. The area of the opposing conductor 23 for adjusting the resonance frequency being connected to the antenna line 40 is thereby reduced, enabling the resonance frequency of the chip antenna 2 to be changed. Accordingly, even after forming the dielectric base body 11*a,* the resonance frequency can be adjusted to be a desired value, thereby improving the yield of the chip antenna 2.

Figure 7:
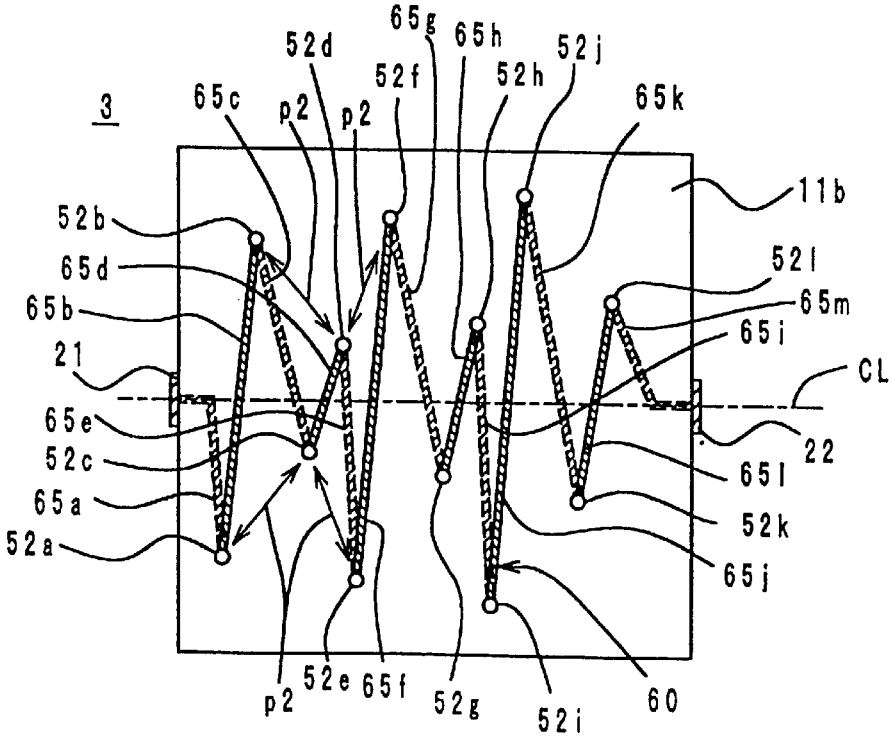
FIG. 7 is a plan view of a chip antenna according to a third embodiment of the present invention.

Third Embodiment, FIG. 7

FIG. 7 is a plan view of a chip antenna 3 according to a third embodiment. In the third embodiment, a spiral antenna line 60 is arranged in a dielectric base body 11*b*, in which the diameter of the spiral line 60 increases gradually as the winding proceeds.

Conductor patterns 65*a* to 65*m* formed in the dielectric base body 11*b* are electrically connected sequentially in series through via holes 52*a* to 52*l* formed in the dielectric base body 11*b* so as to form a spiral antenna line 60. The conductor patterns 65*b*, 65*f*, and 65*j* and the conductor patterns 65*d*, 65*h*, and 65*l* are arranged at intervals of a predetermined pitch and each length thereof increases gradually in order. The via holes 52*b*, 52*d*, 52*f*, 52*h*, 52*j*, and 52*l* are arranged in a staggered arrangement. The via holes 52*a*, 52*c*, 52*e*, 52*g*, 52*i*, and 52*k* are also arranged in a staggered arrangement.

In the chip antenna 3 formed as described above, just like in the second embodiment, the antenna line 60 has a straight winding axis CL, and adjacent wound portions thereof have a different diameter. Since adjacent via holes (the via holes 52*a*, 52*c*, 52*e*, 52*g*, 52*i*, and 52*k*, for example) are arranged in a staggered arrangement, the distance P2 between adjacent via holes (the via holes 52*a* and 52*c*, for example) is larger than the spiral pitch P1 of the antenna line 60. Therefore, even when the spiral pitch P1 of the antenna line 60 is reduced to be smaller, the distance P2 between the adjacent via holes 52*a* and 52*c* can be larger than that of a conventional antenna line, so that limitation in manufacturing may be circumvented. Consequently, the minimum spiral pitch of the antenna line 60 can be smaller than that of a conventional one, thereby enabling the resonance frequency of the chip antenna 3 to be reduced smaller than that of a conventional chip antenna.

Other Embodiments

Figure 8:
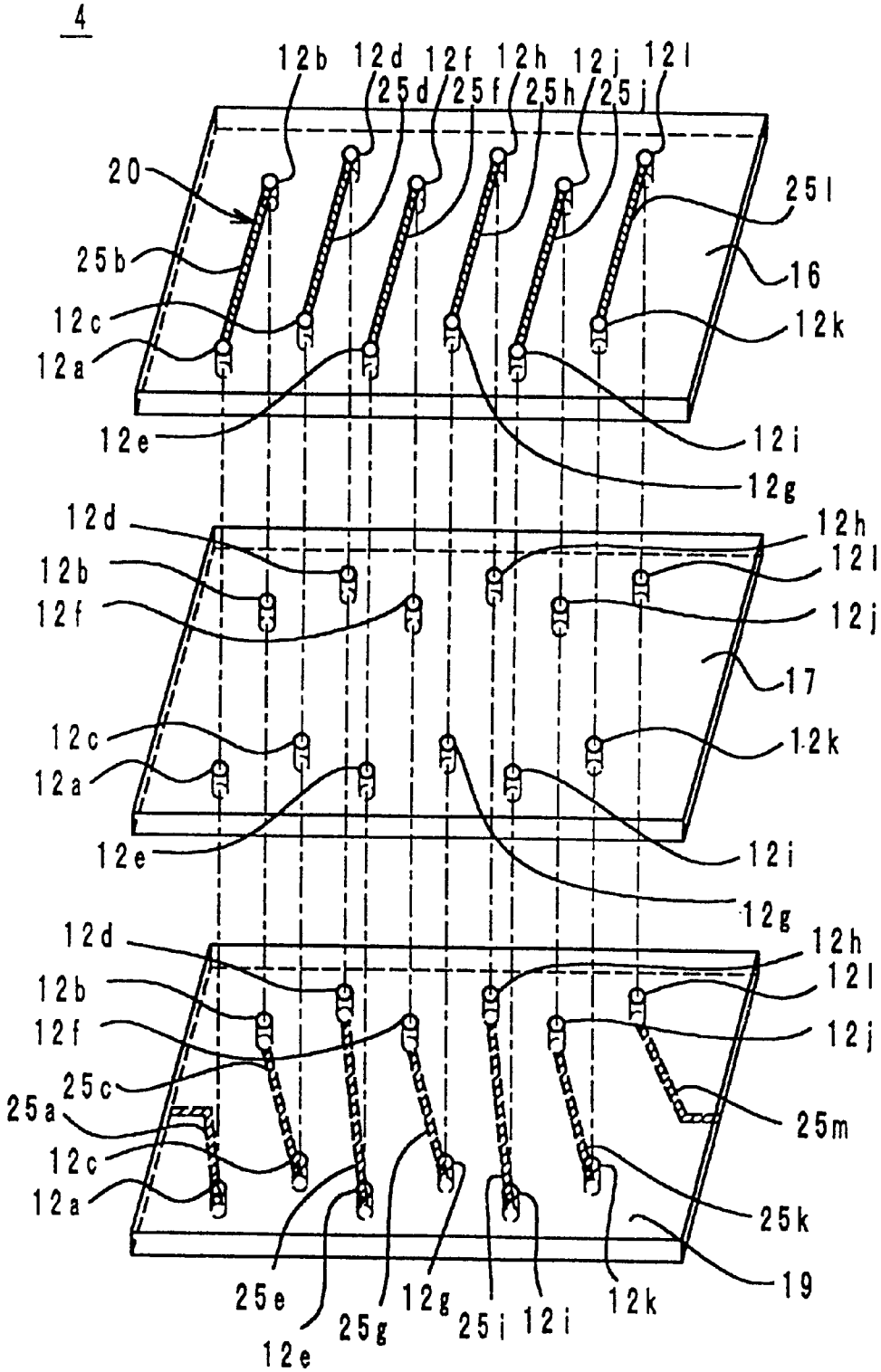
FIG. 8 is a plan view of a chip antenna according to another embodiment of the present invention.
Figure 9:
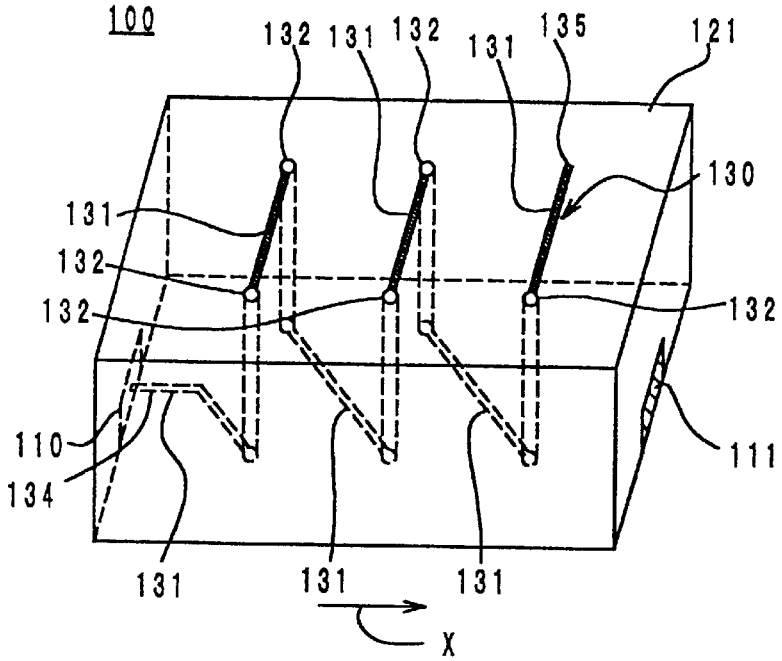
Fig. 9 PRIOR ART
FIG. 9 is a perspective view of a conventional chip antenna.
Figure 10:
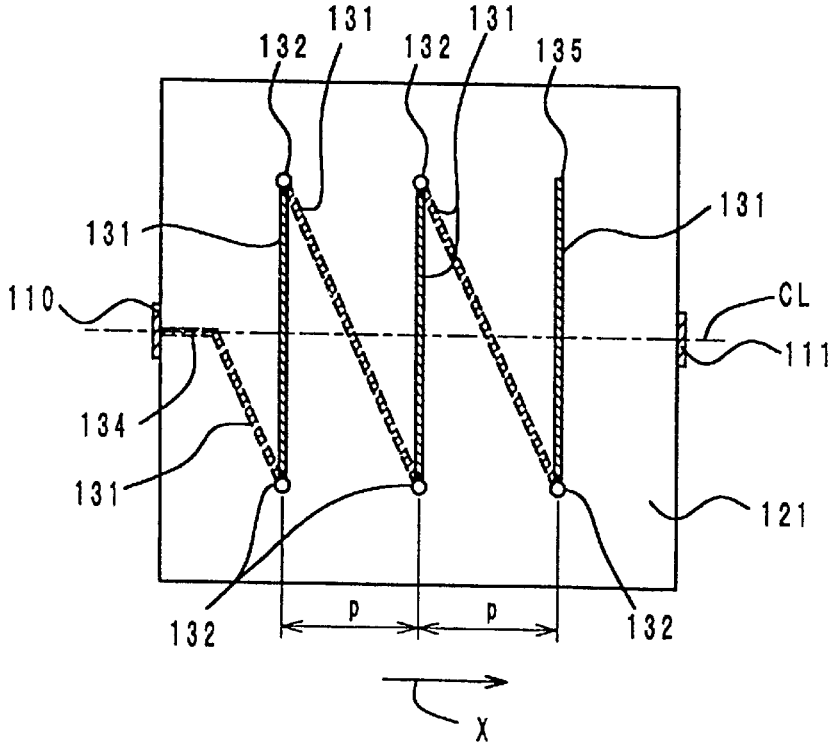
Fig. 10 PRIOR ART
FIG. 10 is a plan view of the chip antenna shown in FIG. 9.

The present invention is not limited to the above-described embodiments, however. Various modifications can be made within the scope of the invention. For example, in the embodiments, the cross-section of the spiral antenna line is rectangular; however it may have an arbitrary shape such as a substantially track shape having straight portions and curved portions or a semi-cylindrical shape. The dielectric base body may be spherical, cubic, cylindrical, conical, or pyramidal as well as being rectangular solid. The entire or part of the antenna line may be embedded into the base body. Also, the entire conductor patterns may be formed on a surface of the base body 11 by using the dielectric sheet 19 shown in FIG. 8 instead of the dielectric sheet 18 according to the first embodiment shown in FIG. 1. Furthermore, the base body may be formed from a magnetic material. One end of the antenna line may be open as shown in FIG. 9.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A chip antenna comprising:

a base body;

an antenna line disposed on or in the base body and being spirally wound; and a feed terminal disposed on a surface of the base body and being electrically connected to one end of the antenna line, wherein the antenna line has a winding axis which is arranged in a zigzag manner.

2. The chip antenna of claim 1, wherein the base body comprises a plurality of laminations, at least two of the laminations having conductors disposed thereon with conductive via holes connecting the conductors on a first lamination to conductors on a second lamination thereby forming the spirally wound antenna line having a rectangular cross section and having a defined pitch and wherein a distance between adjacent through holes is greater than the pitch.

3. A chip antenna of claim 1, further comprising:

a plurality of conductor patterns disposed in the base body; and via holes, wherein the antenna line is formed by electrically connecting the plurality of conductor patterns in series by the via holes which are arranged in the base body in a staggered arrangement.

4. The chip antenna of claim 1, further comprising an opposing conductor for adjusting the resonance frequency, wherein the opposing conductor opposes at least one of the plurality of conductor patterns forming the antenna line and is electrically connected to part of the plurality of conductor patterns.

5. The chip antenna of claim 3, further comprising an opposing conductor for adjusting the resonance frequency, wherein the opposing conductor opposes at least one of the plurality of conductor patterns forming the antenna line and is electrically connected to part of the plurality of conductor patterns.

6. The chip antenna of claim 1, wherein the antenna line has a substantially rectangular cross section.

7. The chip antenna of claim 3, wherein the antenna line has a substantially rectangular cross section.

8. The chip antenna of claim 1, wherein the base body comprises one of a dielectric and a magnetic element.

9. The chip antenna of claim 3, wherein the base body comprises one of a dielectric and a magnetic element.

10. The chip antenna of claim 2, wherein adjacent conductors on at least one of the laminations have equal lengths.

11. The chip antenna of claim 1, wherein the antenna line has a terminal for connection to a power feed at one end.

12. The chip antenna of claim 11, wherein the antenna line has a second end that is provided to a second terminal or left unconnected.

13. A chip antenna comprising:

a base body;

an antenna line disposed on or in the base body and being spirally wound; and a feed terminal disposed on a surface of the base body and being electrically connected to one end of the antenna line; wherein the antenna line has a substantially straight winding axis, and adjacent wound portions of the antenna line have a different length, where the length is defined as a distance extending in one direction from the substantially straight winding axis to each of the adjacent wound portions.

14. The chip antenna of claim 13, wherein the base body comprises a plurality of laminations, two of the laminations having conductors disposed thereon with conductive via holes connecting the conductors on a first lamination to conductors on a second lamination thereby forming the spirally wound antenna line having a rectangular cross section and having a defined pitch and wherein a distance between adjacent through holes is greater than the pitch.

15. A chip antenna of claim 13, further comprising:

a plurality of conductor patterns disposed in the base body; and via holes, wherein the antenna line is formed by electrically connecting the plurality of conductor patterns in series by the via holes which are arranged in the base body in a staggered arrangement.

16. The chip antenna of claim 13, further comprising an opposing conductor for adjusting the resonance frequency, wherein the opposing conductor opposes at least one of the plurality of conductor patterns forming the antenna line and is electrically connected to part of the plurality of conductor patterns.

17. The chip antenna of claim 13, wherein the antenna line has a substantially rectangular cross section.

18. The chip antenna of claim 13, wherein the base body comprises one of a dielectric and a magnetic element.

19. The chip antenna of claim 14, wherein adjacent conductors on both laminations have unequal lengths.

20. The chip antenna of claim 14, wherein the width of adjacent conductors on at least one of the laminations increases from a first end of the base body to a second end.

21. The chip antenna of claim 13, wherein the antenna line has a terminal for connection to a power feed at one end.

22. The chip antenna of claim 21, wherein the antenna line has a second end that is provided to a second terminal or left unconnected.

* * * * *